US008260165B2

(12) United States Patent
Chosokabe et al.

(10) Patent No.: US 8,260,165 B2
(45) Date of Patent: Sep. 4, 2012

(54) IMAGE FORMING APPARATUS AND HEATER CONTROL METHOD

(75) Inventors: Kiriko Chosokabe, Tokyo (JP); Eiji Nemoto, Tokyo (JP); Norikazu Okada, Kanagawa (JP); Takuma Kasai, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 126 days.

(21) Appl. No.: 12/819,461

(22) Filed: Jun. 21, 2010

(65) Prior Publication Data

US 2010/0322656 A1 Dec. 23, 2010

(30) Foreign Application Priority Data

Jun. 22, 2009 (JP) ..... 2009-147945

(51) Int. Cl.
*G03G 15/20* (2006.01)

(52) U.S. Cl. ..... 399/67; 219/216; 219/497; 399/69; 399/88

(58) Field of Classification Search ..... 399/69, 399/88, 67, 33; 219/216, 509, 510, 497
See application file for complete search history.

(56) References Cited

U.S. PATENT DOCUMENTS 6,157,010 A * 12/2000 Mine ..... 219/216 X
6,795,644 B2 * 9/2004 Bradenbaugh ..... 392/463
7,460,808 B2 12/2008 Okada ..... 399/88
2007/0284357 A1 12/2007 Takahashi et al. ..... 219/216
2008/0253791 A1 * 10/2008 Chosokabe ..... 399/70
2009/0074442 A1 3/2009 Sano et al. ..... 399/69

FOREIGN PATENT DOCUMENTS

EP 0 797 130 A2 9/1997
EP 0 875 804 A1 11/1998
EP 1 698 948 A1 9/2006
EP 1 980 918 A2 10/2008
JP 64-9267 U 1/1989
JP 3316170 B2 6/2002

OTHER PUBLICATIONS

Extended Search Report issued May 31, 2011 in European Patent Application No. 10251117.7-1240 / 2278417.

* cited by examiner

*Primary Examiner* — Sophia S Chen
(74) *Attorney, Agent, or Firm* — Oblon, Spivak, McClelland, Maier & Neustadt, L.L.P.

(57) ABSTRACT

An image forming apparatus includes a halogen heater in a fixing unit; an AC source applying an alternating voltage to the halogen heater; a half-wave control unit that performs the heater half-wave control to control the halogen heater on the half-wavelength basis, according to a heater-on/off pattern set for each control cycle having a predetermined length; a heater-off-time measuring unit that measures heater-off period of time; a phase-control-execution determining unit that determines, based on the measured heater-off period of time, whether the heater phase control is to be performed on the alternating voltage, the phase control being performed by shifting phase of the alternating voltage; and a phase control unit that performs, when the phase control is determined to be performed, the phase control only for a period of time depending on the measured heater-off period of time after switch-on of the heater and before execution of the half-wave control.

15 Claims, 11 Drawing Sheets

| COUNT NUMBER | EXECUTION PERIOD OF TIME (T1) [s] |
|---|---|
| 0-250 | - |
| 250-500 | 20 |
| 500-700 | 30 |
| 700 OR MORE | 40 |

IMAGE FORMING APPARATUS AND HEATER CONTROL METHOD

CROSS-REFERENCE TO RELATED APPLICATIONS

The present application claims priority to and incorporates by reference the entire contents of Japanese Patent Application No. 2009-147945 filed in Japan on Jun. 22, 2009.

BACKGROUND OF THE INVENTION

1. Field of the Invention

The present invention is directed to an image forming apparatus and a heater control method.

2. Description of the Related Art

Various on/off control techniques for a heater for a fixing device or the like of an image forming apparatus, such as a copying machine, a printer, and a multifunction peripheral (MFP), have been known. The human eye is most sensitive to light fluctuations in the frequency range near 10 Hz having its center at 8.8 Hz. With recent image forming apparatuses, heater-on/off control timing is set so as to avoid the frequency range where the human eye is sensitive to flicker or such that frequency band is shifted to reduce flicker to a minimum.

For instance, a technique of half-wave control for reducing flicker due to heater control and maintaining low-flicker level stably has been known (for example, Japanese Patent No. 3316170). Under the half-wave control, for example, ten half wavelengths near 10 Hz where the human eye is sensitive to flicker are set as a heater on/off control cycle, and a high-frequency heater on/off pattern designed to avoid a frequency band around 10 Hz is used as a heater on/off pattern within the control cycle.

However, such conventional heater on/off control as discussed above is disadvantageous in that if, in the half-wave control, all half-waves are allocated to heater-on during an initial period after start of the heater on/off control, inrush current undesirably flows when a heater-off state is changed to a heater-on state. In spite that it is desirable to decrease disturbance voltage, the inrush current increases the disturbance voltage, making it difficult to maintain low-flicker level stably.

SUMMARY OF THE INVENTION

It is an object of the present invention to at least partially solve the problems in the conventional technology.

According to an aspect of the present invention, there is provided an image forming apparatus that includes a fixing unit; a heater provided in the fixing unit; an alternating-current power source that applies an alternating voltage to the heater; a half-wave control unit that performs half-wave control to control the heater on a half-wavelength basis, according to a heater-on/off pattern that is set for each control cycle having a predetermined length; a measuring unit that measures, when the heater is switched off, a heater-off period of time that elapses until the heater is next switched on; a determining unit that determines, based on the measured heater-off period of time, whether phase control is to be performed on the alternating voltage to control the heater, the phase control being performed by shifting phase of the alternating voltage; and a phase control unit that performs, when the determining unit determines that the phase control is to be performed, the phase control only for a period of time depending on the measured heater-off period of time after switch-on of the heater and before execution of the half-wave control.

According to another aspect of the present invention, there is provided a heater control method to be executed in an image forming apparatus that includes a fixing unit, a heater provided in the fixing unit, an alternating-current power source that applies an alternating voltage to the heater, a half-wave control unit, a measuring unit, a determining unit, and a phase control unit. The heater control method includes performing, using the half-wave control unit, half-wave control to control the heater on a half-wavelength basis, according to a heater-on/off pattern that is set for each control cycle having a predetermined length; measuring, by the measuring unit, when the heater is switched off, a heater-off period of time that elapses until the heater is next switched on; determining, by the determining unit, based on the measured heater-off period of time, whether phase control is to be performed on the alternating voltage to control the heater, the phase control being performed by shifting phase of the alternating voltage; and performing, using the phase control unit, when it is determined that the phase control is to be performed, the phase control only for a period of time depending on the measured heater-off period of time measured at the measuring after switch-on of the heater and before execution of the half-wave control.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of an image forming apparatus and a heater control method according to the present invention are explained in detail below with reference to the accompanying drawings.

First Embodiment

Figure 1:
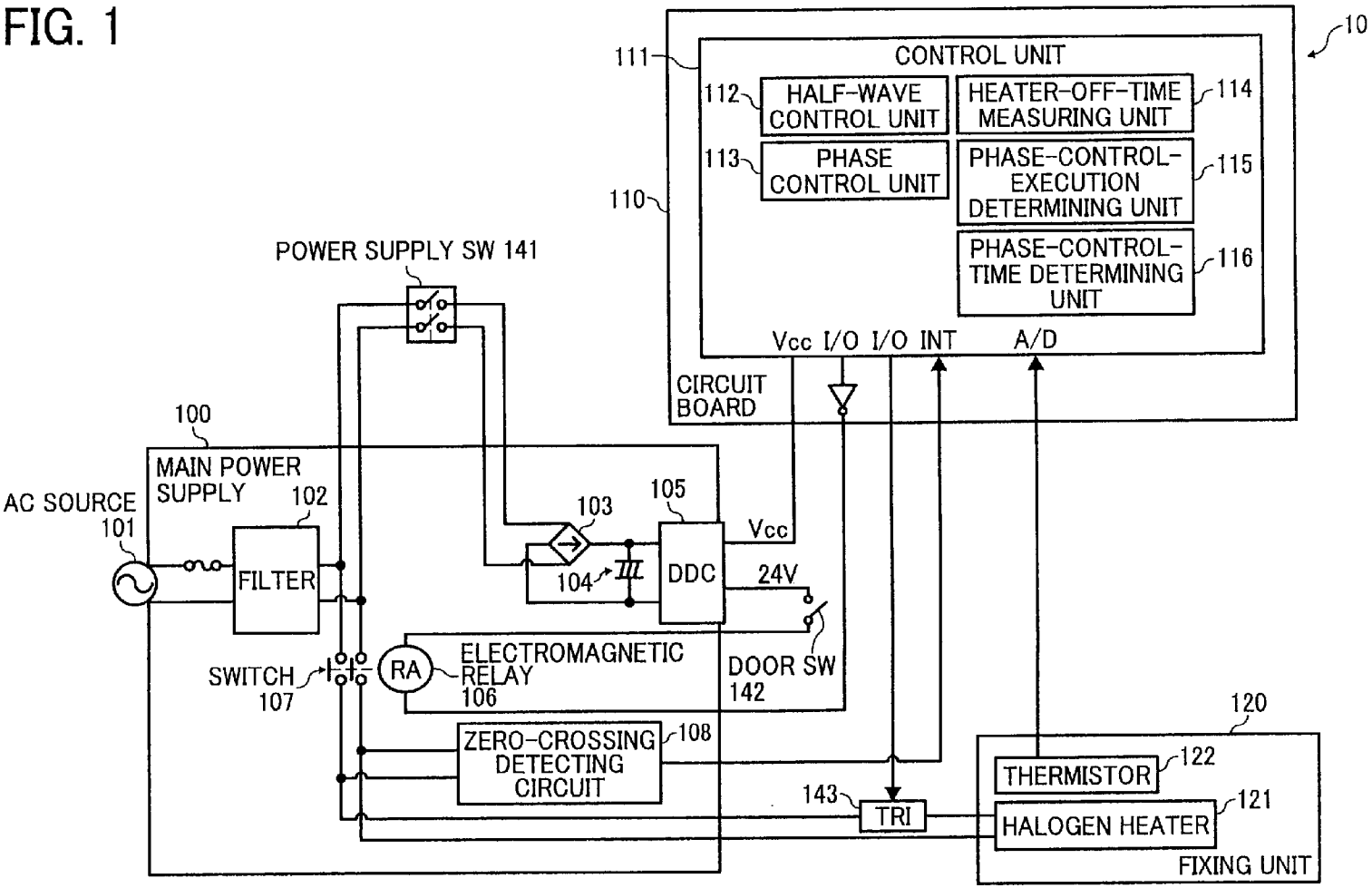
FIG. 1 is a block diagram illustrating the overall configuration of an image forming apparatus according to a first embodiment of the present invention.

FIG. 1 is a block diagram illustrating the overall configuration of an image processing apparatus 10 according to a first embodiment of the present invention. The image forming apparatus 10 generally includes a main power supply 100, a control board 110, and a fixing unit 120. The image forming apparatus 10 further includes a power supply switch (SW) 141, a door SW 142, and a triac (TRI) 143.

The control board 110 controls the overall image forming apparatus 10. The control board 110 is mounted on a computer, to which a central processing unit (CPU), random access memory (RAM), read only memory (ROM), non-volatile RAM (NVRAM), application specific integrated circuit (ASIC), and an input/output interface, which are not shown, are connected via a bus.

The control board 110 controls on and off of the TRI 143 and an electromagnetic relay 106 provided between the main power supply 100 and the fixing unit 120, thereby performing temperature control of the fixing unit 120 and on/off control of a halogen heater 121. Other heater, such as a ceramic heater, can be used in place of the halogen heater 121.

A thermistor 122 provided near the halogen heater 121 of the fixing unit 120 measures surface temperature of the halogen heater 121. The control board 110 performs analog-to-digital (A/D) conversion of the surface temperature measured by the thermistor 122 to obtain the surface temperature of the halogen heater 121. The control board 110 controls on and off of the TRI 143 and the electromagnetic relay 106 for stabilization of the surface temperature.

When the power supply SW 141 of the image forming apparatus 10 is switched on, electric current supplied from an alternating-current (AC) source 101 undergoes noise reduction performed by using a filter 102 and thereafter smoothing performed by using a rectifier diode 103 and a smoothing capacitor 104. The electric current is then fed to a digital down converter (DDC) 105. The DDC 105, which is a switching direct-current (DC)-DC converter, delivers a constant voltage Vcc to the control board 110 and a voltage of 24 volts to the electromagnetic relay 106.

The electromagnetic relay 106 is operable to switch on a switch 107 and switch off the fixing unit 120 via the control board 110 when the door SW 142 of the image forming apparatus 10 is switched on. In other words, the electromagnetic relay 106 serves as a safety lock mechanism of the fixing unit 120.

Zero-crossing detecting circuit 108 detects a zero-crossing point pertaining to the AC source 101. The control board 110 switches on and off the TRI 143 depending on the zero-crossing point. With the switch 107 on, the alternating current fed to the zero-crossing detecting circuit 108 crosses a zero-voltage point every half wavelength. Therefore, it is impossible for a transistor of the zero-crossing detecting circuit 108 to maintain on-state voltage. Upon detecting this state of the transistor, the zero-crossing detecting circuit 108 outputs a zero-crossing signal to the control board 110.

The control board 110 includes a control unit 111 that controls the temperature of the halogen heater 121. The control unit 111 includes a half-wave control unit 112, a phase control unit 113, a heater-off-time measuring unit 114, a phase-control-execution determining unit 115, and a phase-control-time determining unit 116.

The half-wave control unit 112 performs half-wave control, which is on/off control of power supply to the halogen heater 121 on a half-wave basis, according to a heater-on pattern having been set for each control cycle. Meanwhile, the control cycle is a voltage cycle pertaining to the AC source 101 controlled by the control board 110 and is a cycle having a predetermined length. In the half-wave control, the on/off pattern for power supply to the halogen heater 121 is made such that each half wavelength, which is one-half of a wavelength, is allocated to either heater-on or heater-off. Specifically, the half-wave control unit 112 first determines a duty ratio based on the surface temperature and a target temperature of the halogen heater 121. The half-wave control unit 112 further sets a heater-on pattern based on the thus-determined duty ratio. The half-wave control unit 112 switches on and off the TRI 143 according to the heater-on pattern. The heater-on pattern can be made by, for instance, storing a heater-on pattern table, in which duty ratios and heater-on patterns are associated with each other, in advance, and selecting one of the heater-on patterns that is associated with the determined duty ratio.

Figure 2:
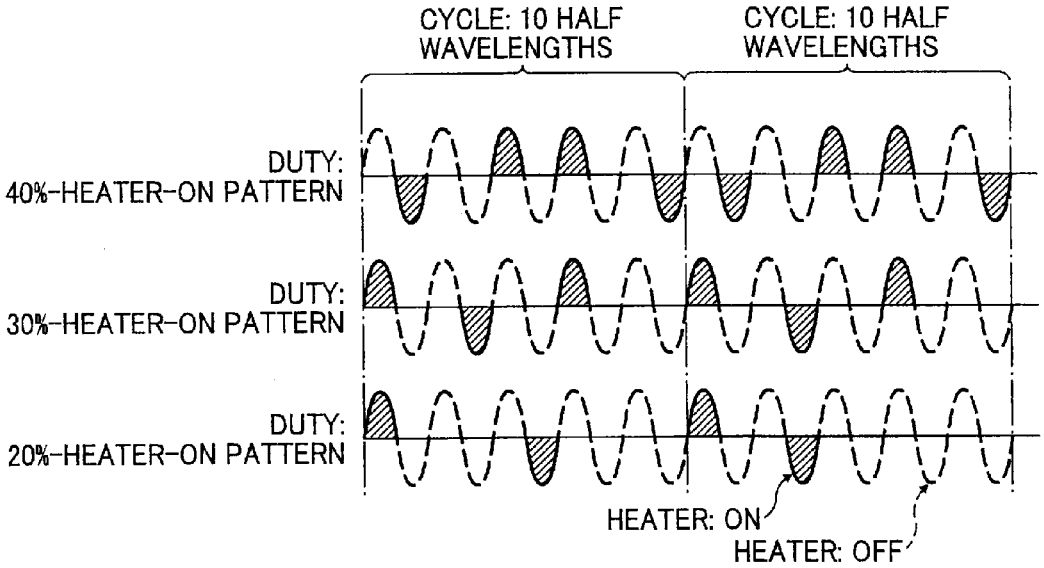
FIG. 2 is an explanatory diagram of a heater-on pattern table.

FIG. 2 is an explanatory diagram of the heater-on pattern table. As illustrated in FIG. 2, a plurality of heater-on patterns that are individually associated with duty ratios are stored. For instance, according to a 40%-heater-on pattern, if each control cycle, which corresponds a voltage cycle of voltage control performed by the control board 110, is ten half wavelengths, electric power is supplied to the halogen heater 121 only during four half wavelengths specified by the pattern. Similarly, according to a 30%-heater-on pattern, electric power is supplied to the halogen heater 121 only during three half wavelengths specified by the pattern.

The phase control unit 113 controls power supply to the halogen heater 121 by shifting phase of the voltage pertaining to the AC source 101.

As discussed above, in the image forming apparatus 10 according to the first embodiment, it is allowed to control the halogen heater 121 by using the two methods, one of which is the half-wave control performed by the half-wave control unit 112 and the other is the phase control performed by the phase control unit 113.

The heater-off-time measuring unit 114 start measurement of a heater-off period of time T when the halogen heater 121 is switched off. Specifically, the heater-off-time measuring unit 114 obtains a count value of zero crossings, which are detected by the zero-crossing detecting circuit 108 one by one over a period between switch-off and next switch-on of the halogen heater 121. The heater-off-time measuring unit 114 then calculates a period of time corresponding to the count value as the heater-off period of time T.

The phase-control-execution determining unit 115 determines, based on the heater-off period of time T measured by the heater-off-time measuring unit 114, whether the phase control is to be performed by the phase control unit 113. Specifically, the phase-control-execution determining unit 115 performs comparison between a predetermined threshold value T0 for a heater-off period of time and the actually-measured heater-off period of time T, and if the heater-off period of time T is equal to or longer than the threshold value T0, determines that the phase control is to be performed. In contrast, if the heater-off period of time T is shorter than the threshold value T0, the phase-control-execution determining unit 115 determines that the phase control is to be skipped.

When it is determined that the phase control is to be performed by the phase-control-execution determining unit 115, the phase-control-time determining unit 116 determines an execution period of time T1, during which the phase control is to be performed, based on the heater-off period of time T. Specifically, the phase-control-time determining unit 116 determines the execution period of time T1 by using the following Equation (1):

$$T1=\alpha\times T+\beta \quad (1),$$

where each of α and β is an arbitrary constant. As discussed above, the phase-control-time determining unit 116 calculates the execution period of time T1 by using such an equation showing that the longer the heater-off period of time T is, the longer the execution period of time T1 becomes.

Because the phase control can cause flicker to occur, duration of the phase control is desirably minimized. Accordingly, it is desirable to set α and β to such values that minimize the length of the execution period of time. The same goes for the threshold value T0 discussed above. There can be some cases where the heater-off period of time T is so short that the phase control is not required. From this point of view, the threshold value T0 is desirably set to such a value that minimizes duration of the phase control.

Figure 3:
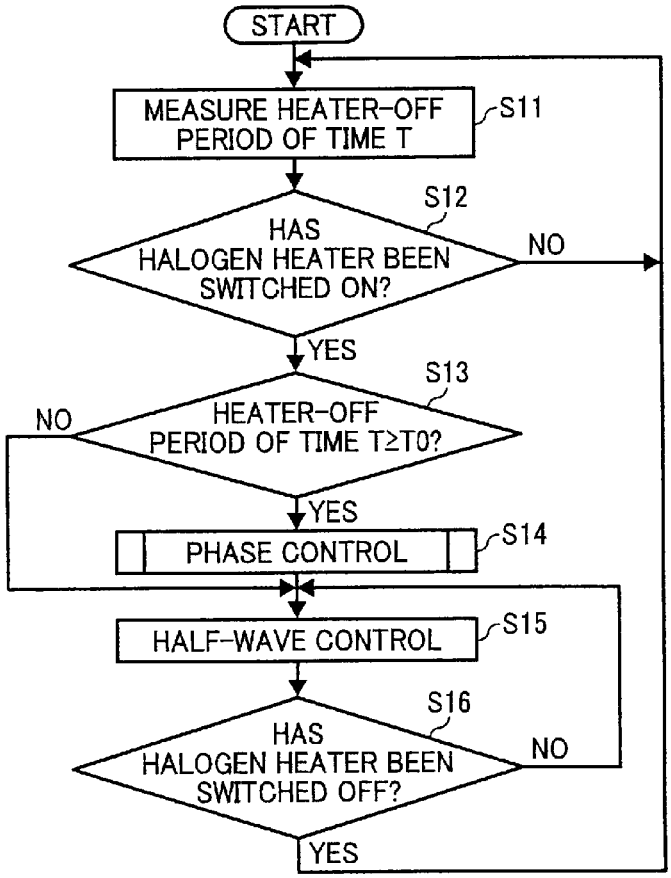
FIG. 3 is flowchart illustrating a process procedure for heater control performed by the image forming apparatus to control a halogen heater.

FIG. 3 is flowchart illustrating a process procedure for heater control performed by the image forming apparatus 10 to control the halogen heater 121. When the halogen heater 121 is switched off, the heater-off-time measuring unit 114 starts measurement of the heater-off period of time T (Step S11), and continues count for measurement of the heater-off period of time T until the halogen heater 121 is switched on (No at Step S12). When the halogen heater 121 is switched on (Yes at Step S12), the phase-control-execution determining unit 115 performs comparison between the heater-off period of time T and the threshold value T0, and if the heater-off period of time T is equal to or longer than the threshold value T0 (Yes at Step S13), the phase-control-execution determining unit 115 determines that the phase control is to be applied. In this case, the phase control unit 113 performs the phase control on the voltage for the halogen heater 121 according to an instruction fed from the phase-control-execution determining unit 115 (Step S14).

After the phase control has been performed for the execution period of time determined by the phase-control-time determining unit 116, the half-wave control unit 112 performs the half-wave control (Step S15). The half-wave control is continued until the halogen heater 121 is switched off (No at Step S16). When the halogen heater 121 is switched off (Yes at Step S16), control returns to Step S11 where measurement of the heater-off period of time is performed.

Because the image forming apparatus 10 is configured such that the phase control is performed prior to the half-wave control only when the heater-off period of time is relatively long, duration of the phase control is minimized, which leads to reduction of flicker.

When the heater-off period of time T is determined to be shorter than the threshold value T0 at Step S13 (No at Step S13), execution of the half-wave control by the half-wave control unit 112 is started with the phase control skipped (Step S15).

Figures 4, 5:
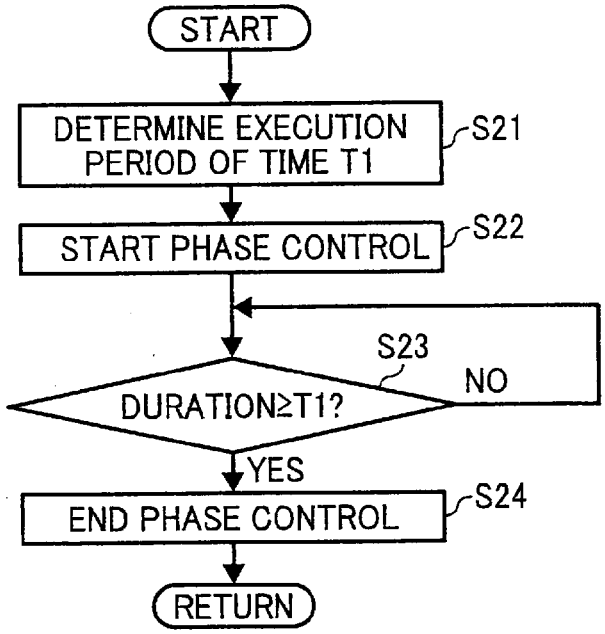
FIG. 4 is a flowchart illustrating a detailed process procedure for phase control (Step S14)
FIG. 5 is a table illustrating a data structure of an application-time table in a simplified form.

FIG. 4 is a flowchart illustrating a detailed process procedure for the phase control (Step S14). The phase control is performed such that the phase-control-time determining unit 116 determines the execution period of time T1 of the phase control by using Equation (1) first (Step S21). Subsequently, the phase control unit 113 starts the phase control (Step S22), and continues the phase control until duration of the phase control performed by the phase control unit 113 becomes equal to the execution period of time T1 (No at Step S23). When the duration has become equal to or longer than the execution period of time T1 (Yes at Step S23), the phase control unit 113 stops the phase control (Step S24).

As discussed above, the image forming apparatus 10 according to the first embodiment is configured such that when the heater-off period of time is equal to or longer than a predetermined period of time, the phase control is performed immediately after switch-on of the heater, and thereafter the half-wave control is performed. Accordingly, the inrush current that flows immediately after the switch-on of the heater in the case where all half-waves are allocated to the heater-on during an initial period after start of the heater-on/off control can be achieved. Furthermore, it is known that execution of the phase control causes flicker to occur. To this end, in the image forming apparatus 10 according to the first embodiment, the phase control is performed only for a minimum duration that depends on heater-off period of time. This allows flicker to be reduced and disturbance voltage to be decreased, thereby ensuring reliability.

As a first modification of the image forming apparatus 10, the control unit 111 can include an execution-time table. In this modification, the phase-control-time determining unit 116 determines the execution period of time T1 based on the execution-time table. FIG. 5 is a table illustrating a data structure of the execution-time table in a simplified form. In the execution-time table, zero-crossing count values and execution period of time are associated with each other. Accordingly, the phase-control-time determining unit 116 refers to the execution-time table and determines application time associated with a counted zero-crossing count value as execution period of time, for a period of which the phase control is to be performed by the phase control unit 113.

In the example given in FIG. 5, no application time is associated with count values from 0 to 250. This means that the threshold value T0 is 250. A configuration in which, when the phase-control-execution determining unit 115 that has referred to the execution-time table finds that no execution period of time is associated with a target count value, the phase-control-execution determining unit 115 determines to skip the phase control, can be employed.

If a required number of lines of the table is relatively small, an execution period of time is preferably determined based on the execution-time table; however, if it is desirable to determine an execution period of time in smaller increments, the execution period of time is preferably determined by using Equation (1) as in the first embodiment. Note that equation for obtaining the execution period of time is not limited to that used in the embodiment, and any equation appropriate for characteristics of a heater can be employed.

In the above discussion, the heater-off-time measuring unit 114 continues count for measurement of the heater-off period of time T until the halogen heater 121 is switched on. Another configuration, in which a threshold value T2 for the heater-off period of time T is set and count for the heater-off period of time T is stopped when the heater-off period of time T has become equal to or longer than the threshold value T2, can be employed as a second modification. In this modification, the phase-control-execution determining unit 115 determines to perform the phase control, and the phase-control-time determining unit 116 determines a predetermined maximum execution period of time as an execution period of time, for a period of which the phase control is to be performed by the phase control unit 113.

By setting an upper limit to measurement of the heater-off period of time T as discussed above, volume of calculations involved in count for the heater-off period of time T can be reduced. In addition, because the need of storing all values of the heater-off period of time T is eliminated, the amount of memory to be used can be reduced.

Still another configuration, in which the heater-off-time measuring unit 114 is a timer that measures duration from switch-off to switch-on of the halogen heater 121, can be employed as a third modification. Still another configuration, in which the heater-off-time measuring unit 114 counts the number of control cycles from switch-off to switch-on of the halogen heater 121, can be employed.

Second Embodiment

Figure 6:
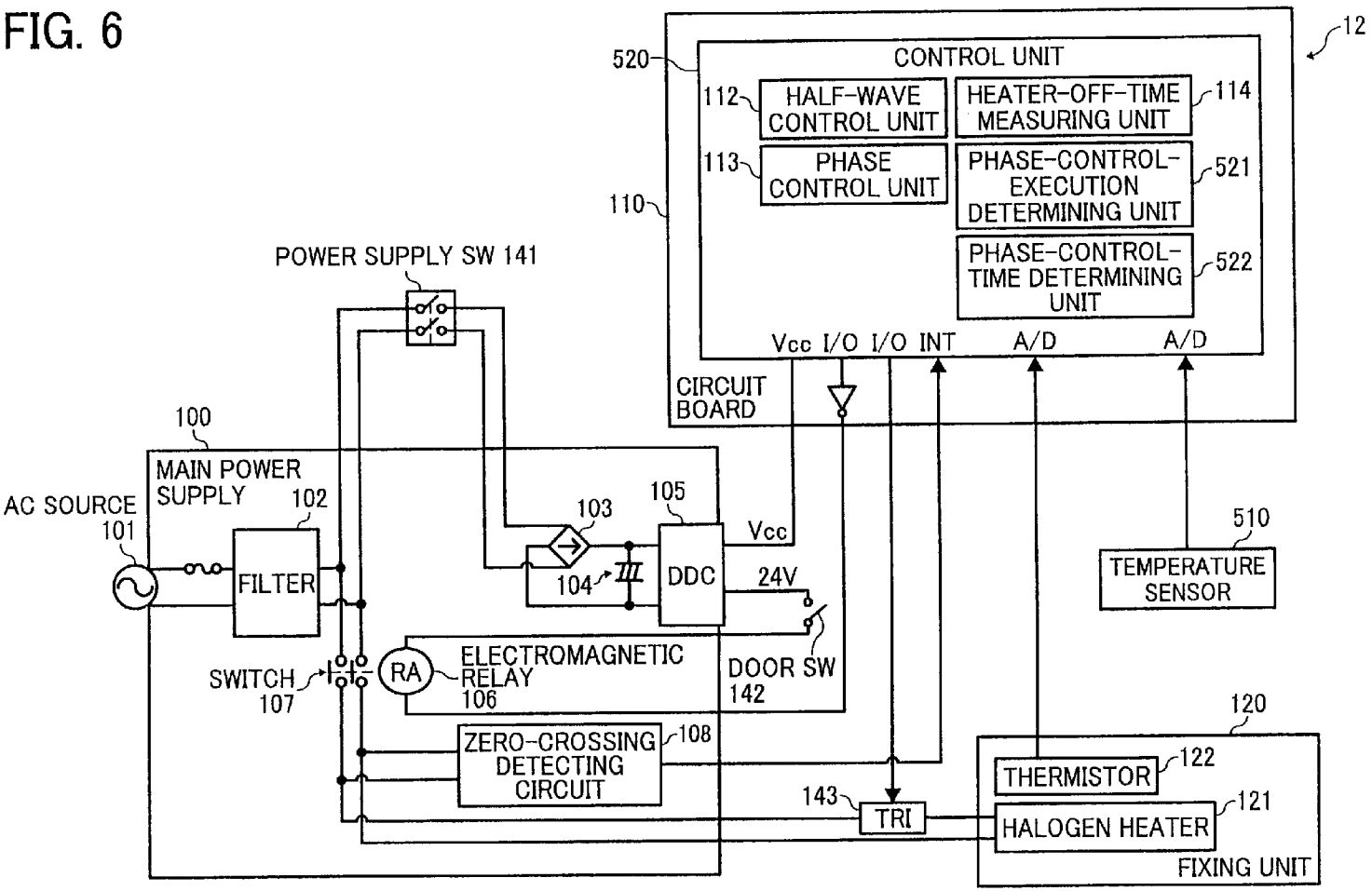
FIG. 6 is a block diagram illustrating the overall configuration of an image forming apparatus according to a second embodiment of the present invention.

FIG. 6 is a block diagram illustrating the overall configuration of an image processing apparatus 12 according to a second embodiment of the present invention. The image forming apparatus 12 includes a temperature sensor 510. The temperature sensor 510 measures the temperature near the fixing unit 120 corresponding to a fixing device. In the example illustrated in FIG. 6, the temperature sensor 510 measures external temperature of the fixing unit 120; however, the temperature sensor 510 can alternatively be provided inside the fixing unit 120 to measure internal temperature of the fixing unit 120.

A phase-control-execution determining unit 521 of a control unit 520 assigns a weight that depends on the temperature measured by the temperature sensor 510 to the heater-off period of time measured by the heater-off-time measuring unit 114. Specifically, when the measured temperature is equal to or higher than a predetermined threshold value T3, the phase-control-execution determining unit 521 obtains weighted heater-off period of time for use in comparison with the threshold value T0 by multiplying the measured heater-off period of time by 0.8, which is the value of weight (hereinafter, "weight value"), and determines whether to perform the phase control.

A phase-control-time determining unit 522 assigns a weight that depends on the temperature measured by the temperature sensor 510 to the heater-off period of time measured by the heater-off-time measuring unit 114 as in the case of the phase-control-execution determining unit 521. Specifically, when the measured temperature is equal to or higher than the predetermined threshold value T3, the phase-control-time determining unit 522 obtains weighted heater-off period of time for use in determination of execution period of time by multiplying the measured heater-off period of time by 0.8, which is the weight value, and determines the execution period of time of the phase control by using Equation (1).

Figure 7:
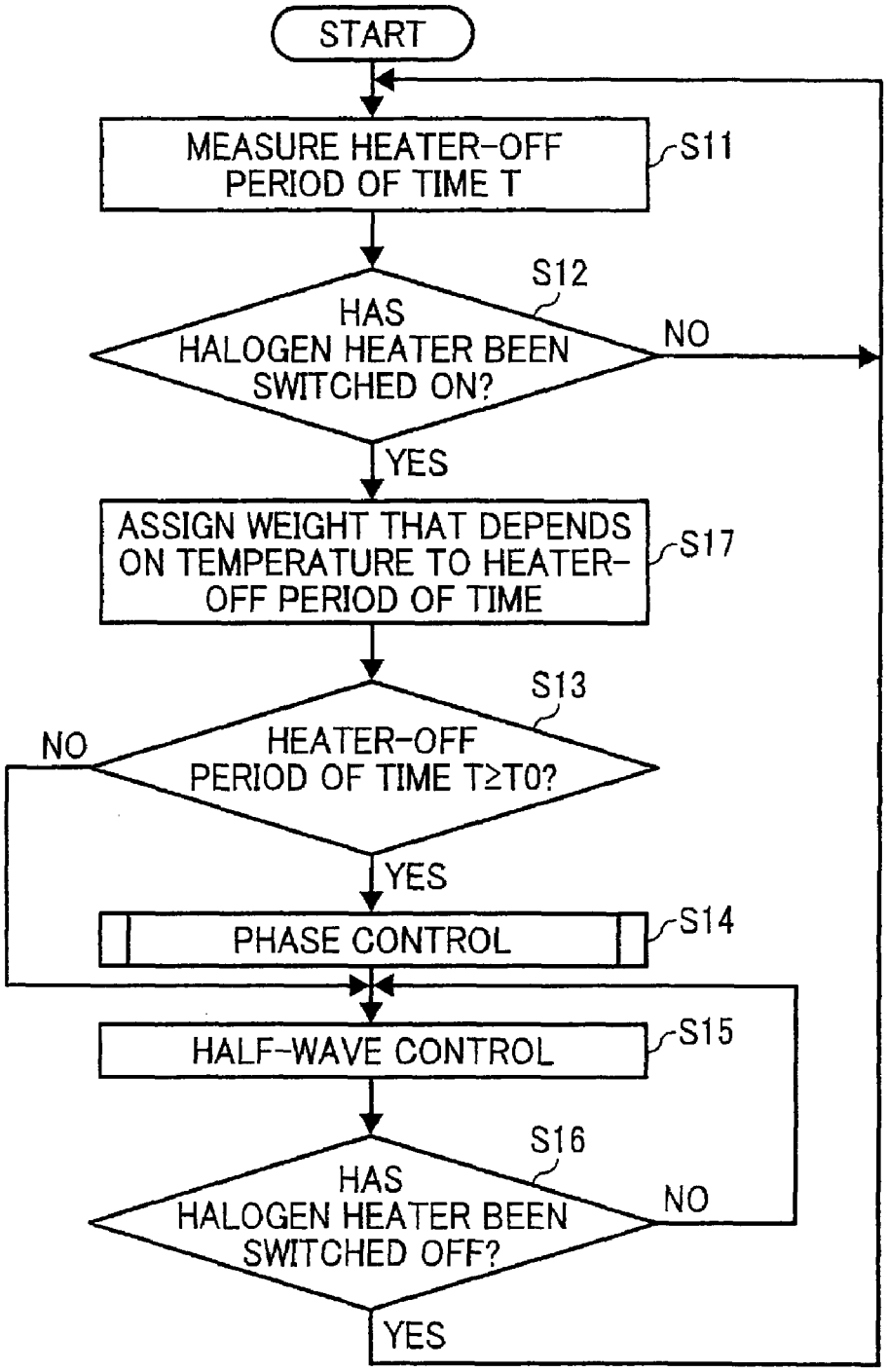
FIG. 7 is a flowchart illustrating a process procedure for heater control.

FIG. 7 is a flowchart illustrating a process procedure for heater control. When the halogen heater 121 is switched on (Yes at Step S12), the phase-control-execution determining unit 521 assigns a weight that depends on the temperature measured by the temperature sensor 510 to heater-off period of time measured by the heater-off-time measuring unit 114 (Step S17). Specifically, when the temperature is equal to or higher than the threshold value T3, the phase-control-execution determining unit 521 obtains weighted heater-off period of time by multiplying the measured heater-off period of time by 0.8, and performs operations pertaining to Step S13 and subsequent steps as discussed above. Put another way, the phase-control-execution determining unit 521 determines whether to perform the phase control based on the weighted heater-off period of time, in which the temperature measured by the temperature sensor 510 is taken into account.

Figure 8:
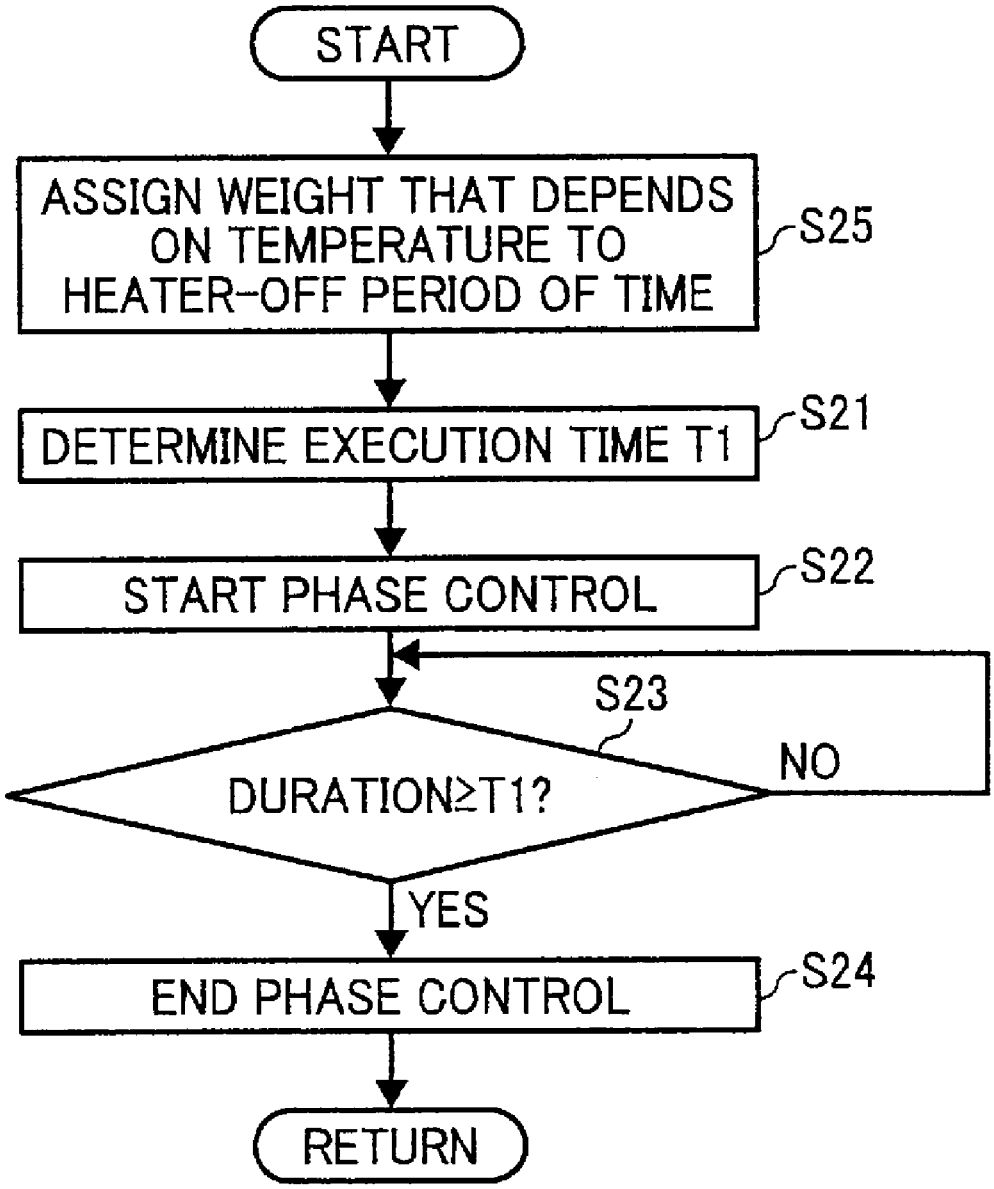
FIG. 8 is a flowchart illustrating a detailed process procedure for the phase control (Step S14)

FIG. 8 is a flowchart illustrating a detailed process procedure for the phase control (Step S14). Also in the phase control, the phase-control-time determining unit 522 assigns a weight that depends on the temperature measured by the temperature sensor 510 to the heater-off period of time measured by the heater-off-time measuring unit 114 first (Step S25). Specifically, when the temperature is equal to or higher than the threshold value T3, the phase-control-time determining unit 522 obtains weighted heater-off period of time by multiplying the measured heater-off period of time by 0.8, and performs operations pertaining to Step S21 and subsequent steps as discussed above. Put another way, the phase-control-time determining unit 522 determines the execution period of time of the phase control based on the weighted heater-off period of time, in which the temperature measured by the temperature sensor 510 is taken into account.

The magnitude of inrush current that flows when the halogen heater 121 is switched on varies depending on the temperature of the fixing unit 120 even after the same heater-off period of time. In view of this circumstance, the image forming apparatus 12 according to the second embodiment assigns a weight that depends on the temperature to heater-off period of time, thereby favorably reducing the inrush current.

Note that other configuration and operations than those discussed above of the image forming apparatus 12 according to the second embodiment are similar to the configuration and operations of the image forming apparatus 10 according to the first embodiment.

Each of the phase-control-execution determining unit 521 and the phase-control-time determining unit 522 of the image forming apparatus 12 according to the second embodiment assigns a weight that depends on the temperature in the above discussion. Another configuration, in which only any one of the phase-control-execution determining unit 521 and the phase-control-time determining unit 522 assigns a weight that depends on the temperature, can be employed as a first modification of the second embodiment. This modification allows various control operations to be performed.

Still another configuration, in which the phase-control-execution determining unit 521 and the phase-control-time determining unit 522 use different threshold values for determination as to whether to perform weighting, can be employed as a second modification of the second embodiment. The weight value used by the phase-control-execution determining unit 521 and that used by the phase-control-time determining unit 522 can differ from each other. This allows evaluations to be made appropriately for each processing.

Still another configuration, in which when the temperature is lower than the threshold value T3, the weighted heater-off period of time is obtained by multiplying the measured heater-off period of time by such a weight value, e.g., 1.2, as to extend the length of the weighted heater-off period of time, can be employed as a third modification of the second embodiment.

In the second embodiment, weighting is performed when the temperature is equal to or higher than the threshold value T3. Still another configuration, in which, for instance, there has been set in advance an equation for calculating a weight value from the temperature such that the weight value decreases as the temperature increases, and heater-off period of time for use in determination as to whether to perform the phase control and determination of an execution period of time is determined by multiplying measured heater-off period of time by a weight value calculated by the using the equation, can be employed as a fourth modification of the second embodiment.

Third Embodiment

Figure 9:
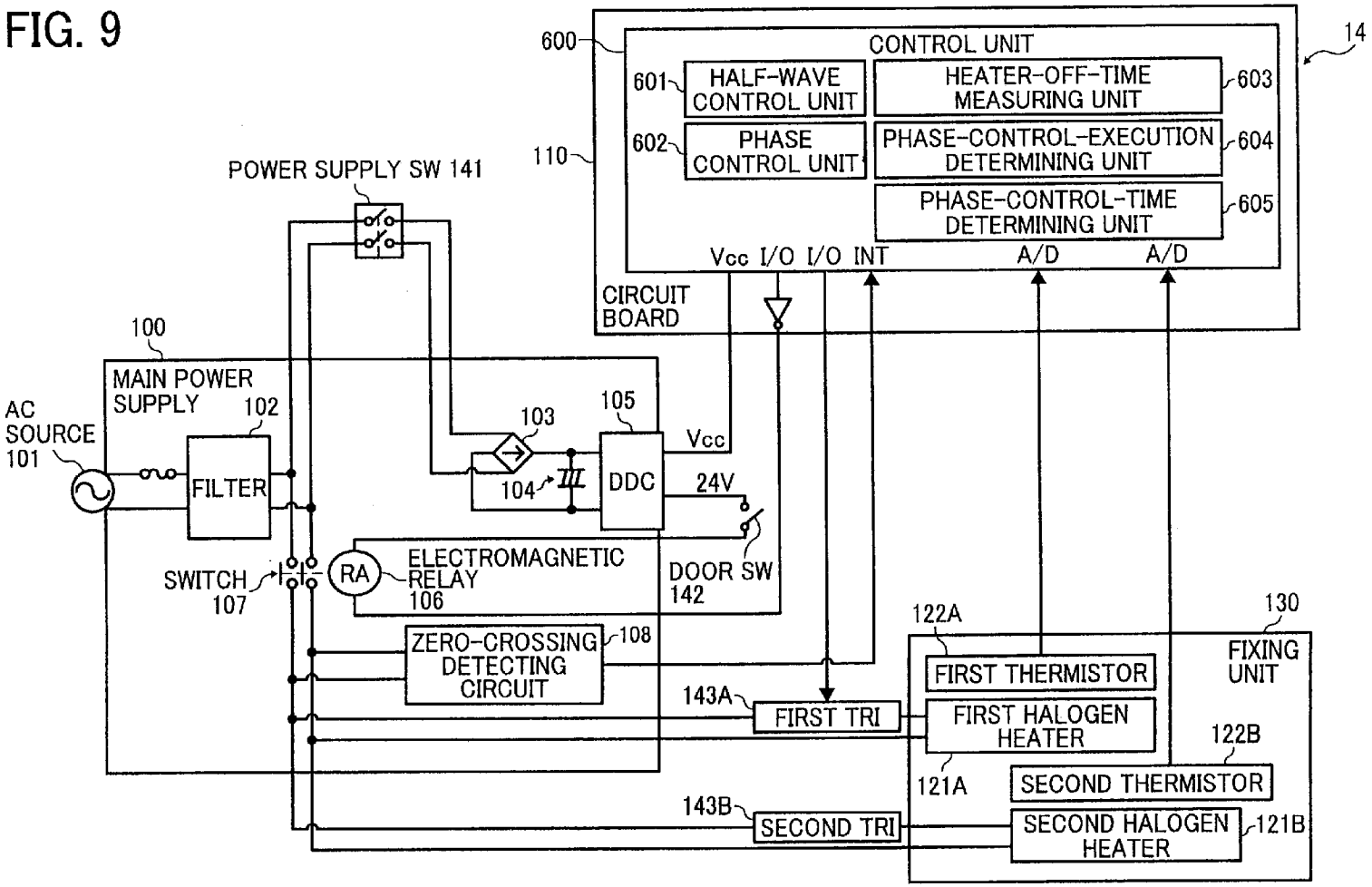
FIG. 9 is a block diagram illustrating the overall configuration of an image forming apparatus according to a third embodiment of the present invention.

FIG. 9 is a block diagram illustrating the overall configuration of an image processing apparatus 14 according to a third embodiment of the present invention. The image forming apparatus 14 includes a plurality of halogen heaters. An example where the image forming apparatus 14 includes two halogen heaters, or specifically a heater that heats a center portion of a fixing device and a heater that heats an end portion of the fixing device, will be described below. A fixing unit 130 includes a first halogen heater 121A and a second halogen heater 121B. The fixing unit 130 further includes a first thermistor 122A that measures surface temperature of the first halogen heater 121A and a second thermistor 122B that measures surface temperature of the second halogen heater 121B. The image forming apparatus 14 further includes a first TRI 143A and a second TRI 143B associated with the first halogen heater 121A and the second halogen heater 121B, respectively.

A half-wave control unit 601 of a control unit 600 applies the half-wave control to the first halogen heater 121A and the half-wave control to the second halogen heater 121B. A phase control unit 602 performs the phase control for the first halogen heater 121A and the phase control for the second halogen heater 121B. A heater-off-period of time measuring unit 603 measures heater-off period time of the first halogen heater 121A and heater-off period of time of the second halogen heater 121B.

A phase-control-execution determining unit 604 determines whether to apply the phase control to the first halogen heater 121A based on heater-off period of time T of the first halogen heater 121A, and further determines whether to apply the phase control to the second halogen heater 121B based on heater-off period of time T of the second halogen heater 121B. A phase-control-time determining unit 605 determines an execution period of time of the phase control for the first halogen heater 121A based on the heater-off period of time T of the first halogen heater 121A, and further determines an execution period of time of the phase control for the second halogen heater 121B based on the heater-off period of time T of the second halogen heater 121B.

When a plurality of heaters are provided, there can be many cases where multiple heaters are switched off and, after the heaters have been cooled down, the heaters are switched on concurrently. There can also be a case where the heaters are concurrently switched on by chance. Applying the phase control concurrently to multiple heaters increases the severity of flicker effect, which is undesirable. To this end, in the third embodiment, a priority heater is designated in advance and such heater control as to avoid concurrent execution of the phase control is employed.

Figure 10:
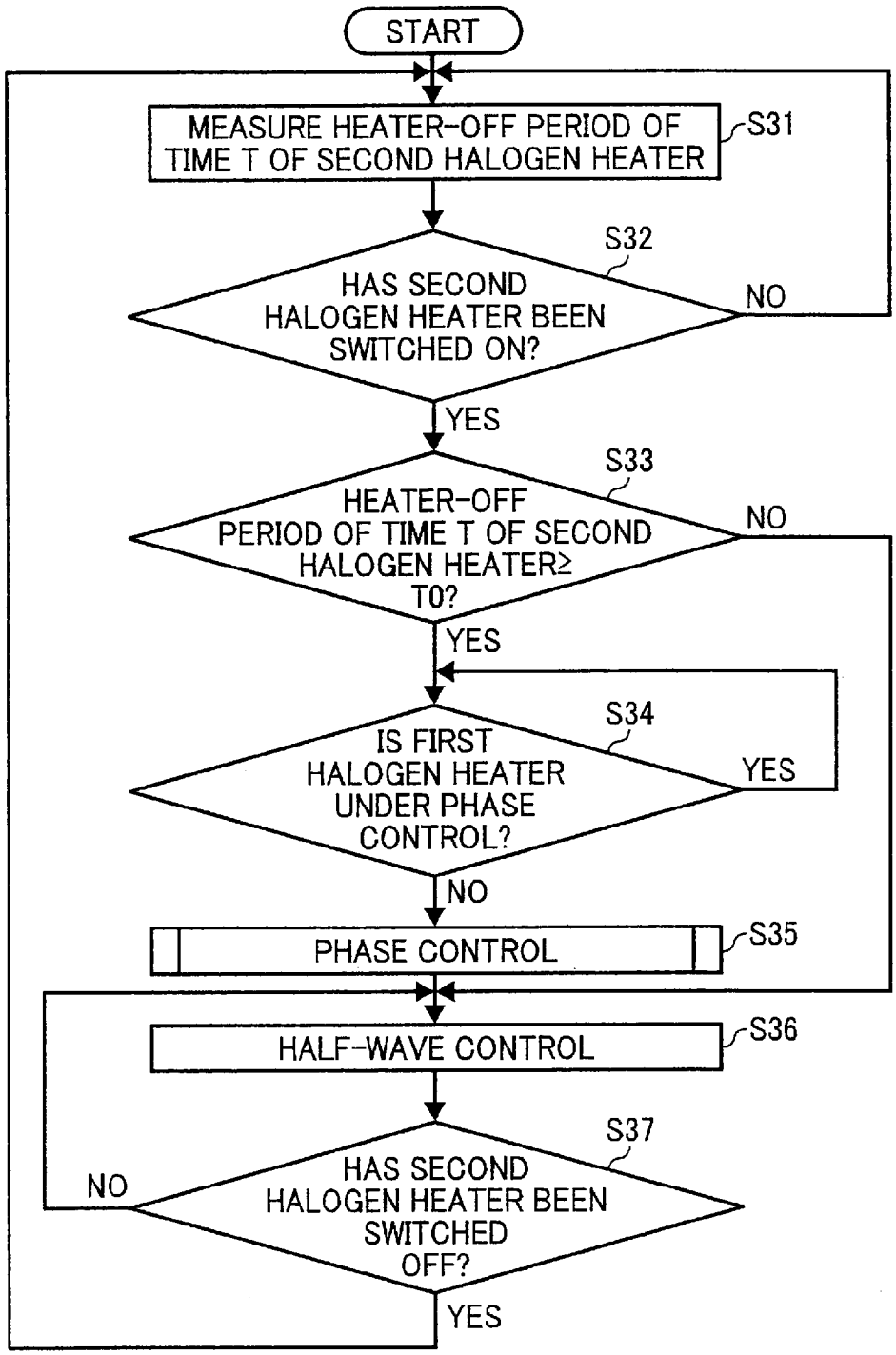
FIG. 10 is a flowchart illustrating a process procedure for heater control to be applied to a halogen heater that is not designated as a priority heater.

FIG. 10 is a flowchart illustrating a process procedure for heater control to be applied to a halogen heater that is not designated as the priority heater. In the third embodiment, it is assumed that it is determined in advance that priority is to be given to the first halogen heater 121A. When the second halogen heater 121B is switched off, the heater-off-time measuring unit 603 starts measurement of the heater-off period of time T of the second halogen heater 121B (Step S31), and continues count for measurement of the heater-off period of time T until the second halogen heater 121B is switched on (No at Step S32).

When the second halogen heater 121B is switched on (Yes at Step S32), the phase-control-execution determining unit 604 performs comparison between the heater-off period of time T and the threshold value T0, and when the heater-off period of time T is equal to or longer than the threshold value T0 (Yes at Step S33), the phase-control-execution determining unit 604 further determines whether the first halogen heater 121A is under the phase control performed by the phase control unit 602. When the first halogen heater 121A is under the phase control (Yes at Step S34), the phase-control-execution determining unit 604 waits for completion of the phase control of the first halogen heater 121A without causing the phase control of the second halogen heater 121B to start. When the phase control of the first halogen heater 121A has been completed or when the first halogen heater 121A is not under the phase control (No at Step S34), the phase control unit 602 performs the phase control for the second halogen heater 121B (Step S35). After the phase control has been performed for the execution period of time determined by the phase-control-time determining unit 605, the half-wave control unit 601 performs the half-wave control (step S36). The half-wave control is continued until the second halogen heater 121B is switched off (No at Step S37). When the second halogen heater 121B is switched off (Yes at Step S37), control returns to Step S31 where measurement of the heater-off period of time is performed.

As discussed above, the heater control with the image forming apparatus 14 according to the third embodiment is configured such that while a priority halogen heater is under the phase control, the phase control is not applied to other halogen heater, and the phase control for the other halogen heater is started after completion of the phase control for the priority halogen heater. This leads to flicker reduction.

Other heater control operations of the third embodiment than those discussed above are similar to heater control operations of the first embodiment discussed earlier with reference to FIG. 3. Heater control operations to be performed on a halogen heater designated as the priority heater is similar to the heater control operations discussed earlier with reference to FIG. 3.

Figure 11:
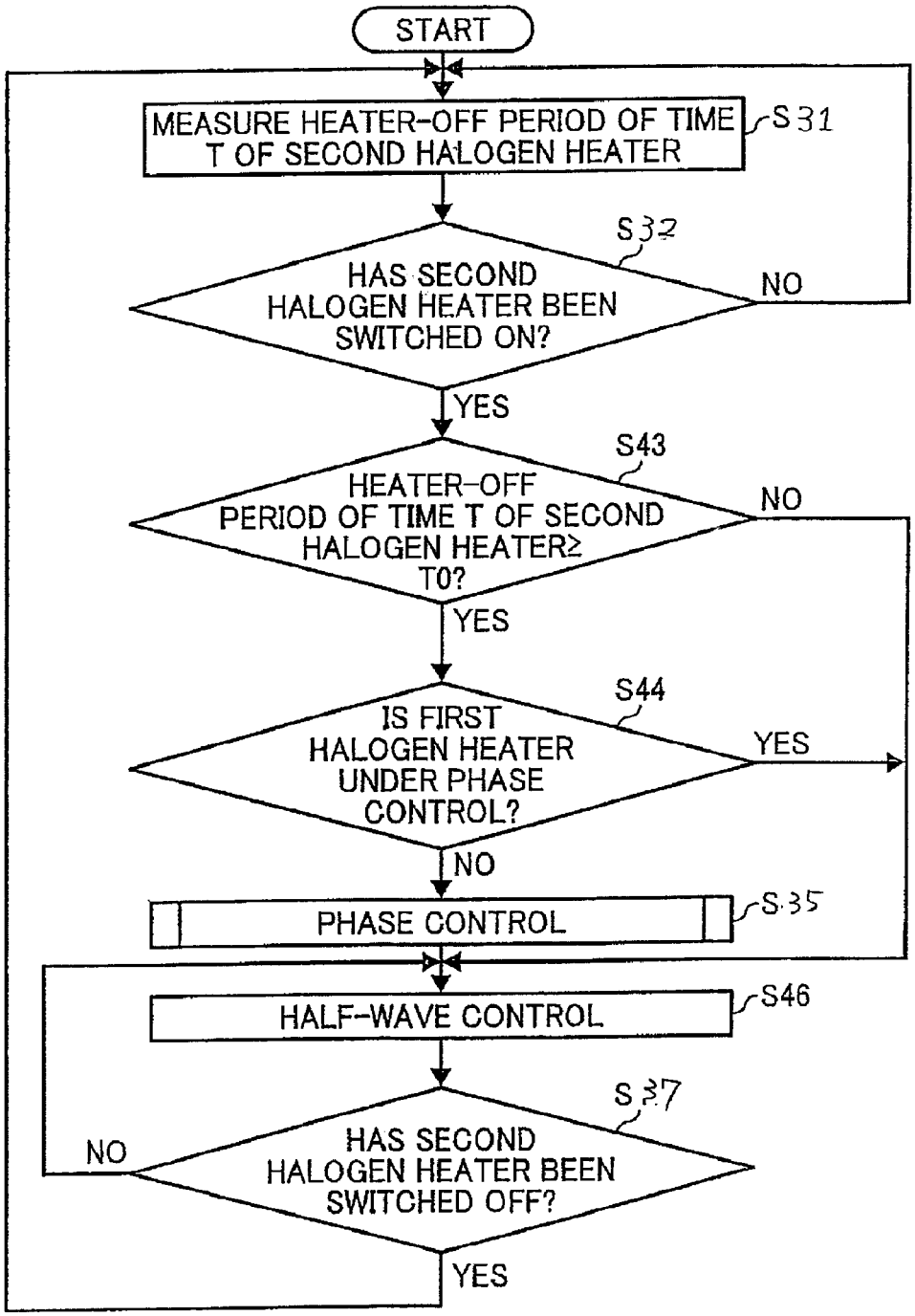
FIG. 11 is a flowchart illustrating a process procedure for heater control according to a first modification of the third embodiment.

As a first modification of the image forming apparatus 14 according to the third embodiment, another configuration, in which when the priority heater is under the phase-control, the other heater is first subjected to the half-wave control with the phase control to be performed skipped, in place of execution of the phase control for the other heater after completion of the phase control for the priority heater. FIG. 11 is a flowchart illustrating a process procedure for heater control according to the first modification of the third embodiment. Even when the heater-off period of time T of the second halogen heater 121B is equal to or longer than the threshold value T0 and the phase-control-execution determining unit 604 has determined to perform the phase control for the second halogen heater 121B (Yes at Step S43), when the first halogen heater 121A is under the phase control (Yes at Step S44), the second halogen heater 121B is first subjected to the half-wave control performed by the half-wave control unit 601 with the phase control to be performed by the phase control unit 602 skipped (Step S46). Accordingly, concurrent execution of the phase control for a plurality of heaters can be avoided, whereby flicker is reduced.

Fourth Embodiment

Figure 12:
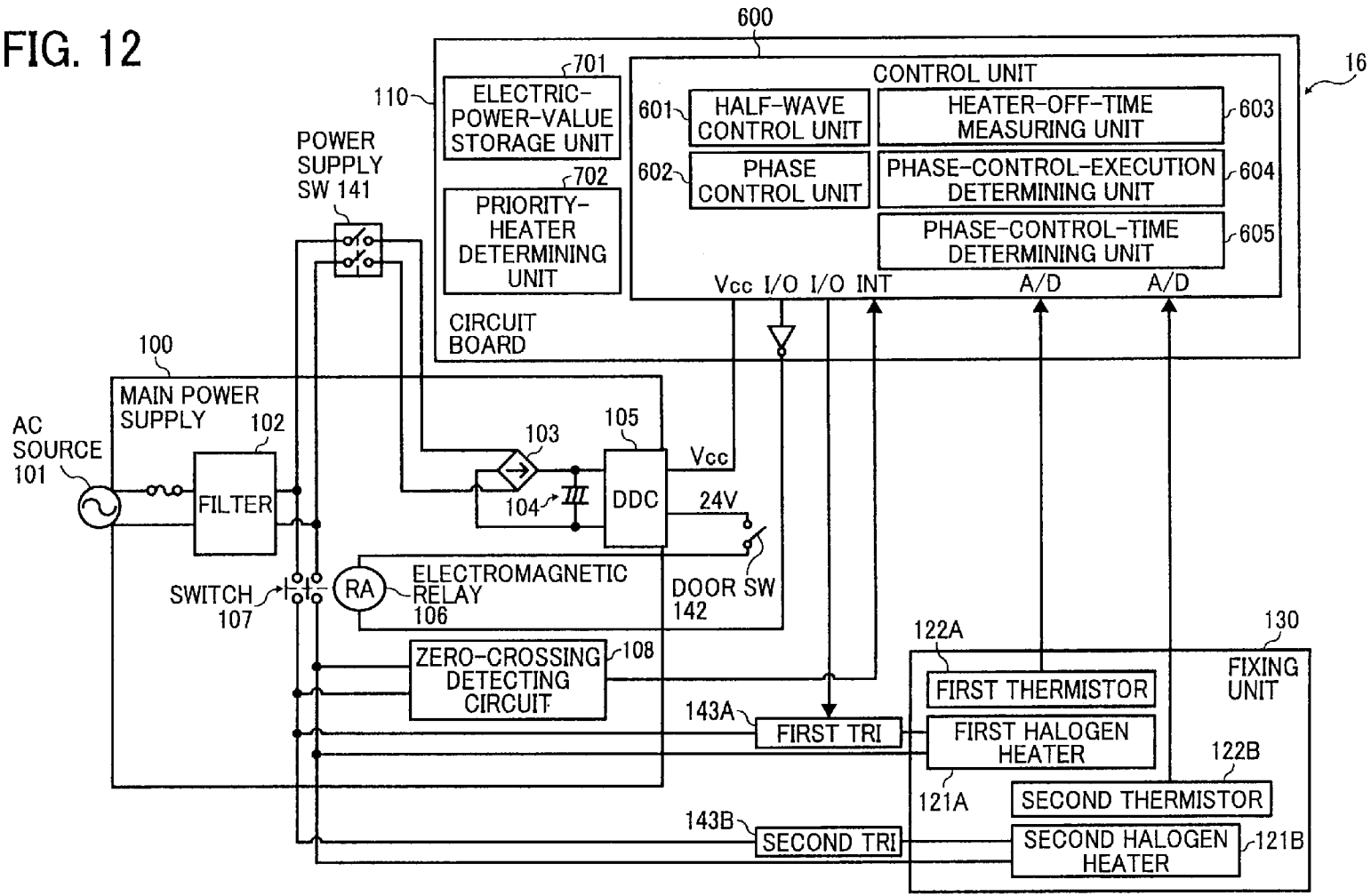
FIG. 12 is a block diagram illustrating the overall configuration of an image forming apparatus according to a fourth embodiment of the present invention.

FIG. 12 is a block diagram illustrating the overall configuration of an image processing apparatus 16 according to a fourth embodiment of the present invention. Although the image processing apparatus 16 according to the fourth embodiment is substantially identical with the image processing apparatus 14 according to the third embodiment, the image processing apparatus 16 differs from the image processing apparatus 14 in further determining which one of the halogen heaters is to be designated as the priority heater.

The control board 110 of the image forming apparatus 16 according to the fourth embodiment includes, in addition to the control unit 600, an electric-power-value storage unit 701 and a priority-heater determining unit 702. The electric-power-value storage unit 701 stores electric power consumption of each of the halogen heaters 121A and 121B. The priority-heater determining unit 702 determines which one of the halogen heaters is to be designated as the priority heater based on the electric power consumption of each of the halogen heaters 121A and 121B stored in the electric-power-value storage unit 701.

Figure 13:
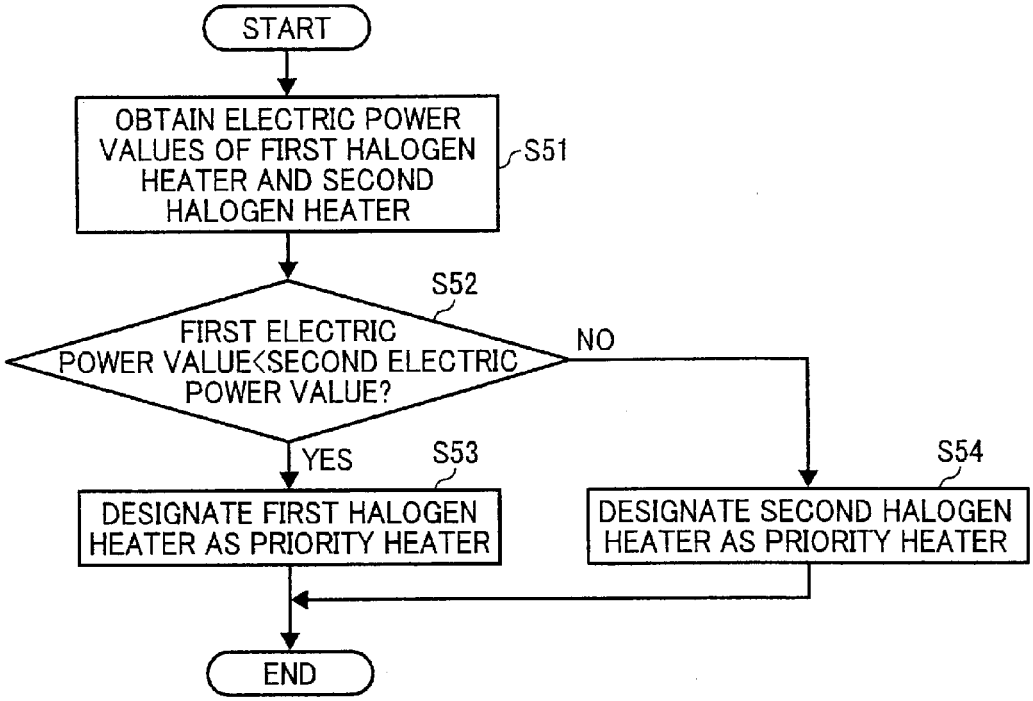
FIG. 13 is a flowchart illustrating a process procedure for priority heater determination.

FIG. 13 is a flowchart illustrating a process procedure for priority heater determination. The priority-heater determining unit 702 obtains a first electric power value, which is electric power consumption of the first halogen heater 121A, and a second electric power value, which is electric power consumption of the second halogen heater 121B, from the electric-power-value storage unit 701 first (Step S51). Subsequently, the priority-heater determining unit 702 performs comparison between the first electric power value and the second electric power value, and when the first electric power value is smaller than the second electric power value (Yes at Step S52), designates the first halogen heater 121A as the priority heater (Step S53). In contrast, when the first electric power value is equal to or greater than the second electric power value (No at Step S52), the priority-heater determining unit 702 designates the second halogen heater 121B as the priority heater (Step S54). Priority heater determination is completed with the designation.

When there are provided a plurality of halogen heaters whose electric power values differ from one another, magnitude of inrush current varies depending on the values of electric power consumption of the halogen heaters. In view of this circumstance, the image forming apparatus 16 according to the fourth embodiment is configured to determine the priority heater based on values of electric power consumption, thereby reducing flicker to a minimum.

Note that other configuration and operations than those discussed above of the image forming apparatus 16 according to the fourth embodiment are similar to the configuration and operations of the image forming apparatuses according to the other embodiments.

Figure 14:
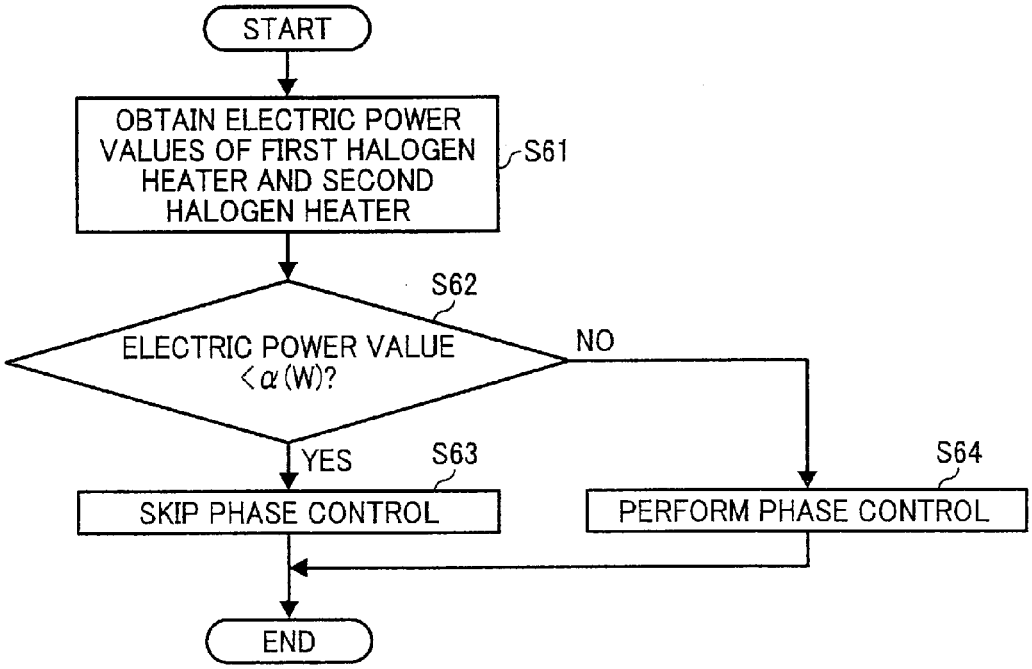
FIG. 14 is a flowchart illustrating a process procedure for electric-power-value determination according to a first modification of the fourth embodiment.

Another configuration, in which when the electric power value is smaller than a predetermined threshold value $\alpha$ (W), the priority-heater determining unit 702 determines that only the half-wave control is to be applied and the phase control is to be skipped when the halogen heater is switched on, can be employed as a first modification of the fourth embodiment. FIG. 14 is a flowchart illustrating a process procedure for electric-power-value determination according to the first modification of the fourth embodiment. In the electric-power-value determination, the priority-heater determining unit 702 obtains the first electric power value of the first halogen heater 121A and the second electric power value of the second halogen heater 121B stored in the electric-power-value storage unit 701 (Step S61).

Thereafter, the priority-heater determining unit 702 performs comparison between each of the electric power values and the threshold value $\alpha$ (W). When the electric power value is smaller than the threshold value $\alpha$ (W) (Yes at Step S62), the priority-heater determining unit 702 determines that the phase control is to be skipped (Step S63). In contrast, when the electric power value is equal to or greater than the threshold value $\alpha$ (W) (No at Step S62), the priority-heater determining unit 702 determines that the phase control is to be applied (Step S64). As a matter of course, even when it is determined that the phase control is to be performed in the electric-power-value determination, the phase control is to be skipped when the phase-control-execution determining unit 604 of the control unit 600 has determined that the phase control is to be skipped.

As discussed above, according to the first modification of the fourth embodiment, the phase control is skipped when electric power consumption is too small. Accordingly, flicker caused by unnecessary application of the phase control can be prevented.

Still another configuration, in which a weight that depends on electric power consumption is assigned to a heater-off period of time, can be employed as a second modification of the fourth embodiment. For instance, as in the case of the weighting by using a weight that depends on the temperature discussed in the second embodiment, a configuration, in which when electric power consumption is equal to or greater than a threshold value, a weighted heater-off period of time is obtained by multiplying measured heater-off period of time by 1.2, can be employed. As in this case, when the electric power consumption is relatively large, a weight that extends the length of phase control time is assigned. Thereafter, whether to perform the phase control and an execution period of time of the phase control are determined based on the weighted heater-off period of time. Put another way, whether to perform the phase control and an execution period of time of the phase control are determined based on the weighted heater-off period of time, in which the electric power consumption is taken into account. This allows execution of the phase control to be minimized.

Each of the image forming apparatuses according to the embodiments includes a control device, such as a CPU, a storage device, such as ROM and/or RAM, an external storage device, such as a hard disk drive (HDD) and/or a compact disk (CD) drive, a display device, and an input device, such as a keyboard and a mouse, and has a hardware configuration that utilizes a general computer. Control program to be executed by each of the image forming apparatuses of the embodiments can be provided as being recorded in a computer-readable recording medium such as a CD-ROM, a flexible disk (FD), a CD-recordable (CD-R), or a digital versatile disk (DVD) in an installable or executable format.

Alternatively, the control program to be executed by each of the image forming apparatuses of the embodiments can be configured to be stored in a computer connected to a network, such as the Internet, so as to be provided by being downloaded via the network. Still alternatively, the control program to be executed by each of the image forming apparatuses of the embodiments can be configured so as to be provided or distributed via a network, such as the Internet. Still alternatively, the control program to be executed by each of the image forming apparatuses of the embodiments can be configured to be provided as being pre-installed in ROM or the like.

The control program to be executed by each of the image forming apparatuses of the embodiments has a module configuration that includes the units discussed above. From the viewpoint of actual hardware, the CPU (processor) reads the control program from the storage medium and executes the control program to load the units on a main memory device, whereby the units are generated on the main memory device.

The embodiments have been discussed by way of examples where the image forming apparatus is applied to an MFP that has at least two functions of a copying function, a printer function, a scanner function, and a facsimile function; however, the image forming apparatus can be applied to any one of an MFP, a printer, a scanner, a facsimile machine, and a like image forming apparatus.

According to the embodiments, there is yielded an effect of maintaining flicker level low stably.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a fixing unit;

a heater provided in the fixing unit;

a first temperature measuring unit that measures temperature of the fixing unit;

an alternating-current power source that applies an alternating voltage to the heater;

a storage unit that stores a plurality of patterns controlling on/off of the heater on a half-wavelength basis of a voltage cycle pertaining to the alternating-current power source;

a half-wave control unit that determines a pattern from the patterns stored in the storage unit based on the temperature measured by the first temperature measuring unit and a target temperature of the fixing unit, and performs half-wave control to control the heater according to the determined pattern;

a measuring unit that measures, when the heater is switched off, a heater-off period of time that elapses until the heater is next switched on;

a determining unit that determines, based on the measured heater-off period of time, whether phase control is to be performed on the alternating voltage to control the heater, the phase control being performed by shifting phase of the alternating voltage; and a phase control unit that performs, when the determining unit determines that the phase control is to be performed, the phase control only for a period of time depending on the measured heater-off period of time after switch-on of the heater and before execution of the half-wave control.

2. The image forming apparatus according to claim 1, wherein the determining unit determines that the phase control is to be performed when the heater-off period of time is equal to or longer than a predetermined period of time.

3. The image forming apparatus according to claim 1, wherein the phase control unit performs the phase control in such a manner that the longer the heater-off period of time is, the longer the execution period of time of the phase control becomes.

4. The image forming apparatus according to claim 1, further comprising a second temperature measuring unit that measures any one of temperature inside of and temperature outside of the fixing unit, wherein the determining unit determines, also based on the temperature measured by the second temperature measuring unit, whether the phase control is to be performed.

5. The image forming apparatus according to claim 4, wherein the phase control unit performs the phase control for a period of time further depending on the temperature measured by the second temperature measuring unit.

6. The image forming apparatus according to claim 5, wherein the phase control unit performs the phase control for a period of time depending on a weighted heater-off period of time, the weighted heater-off period of time being obtained by assigning a weight that depends on the temperature to the heater-off period of time.

7. The image forming apparatus according to claim 1, wherein the heater includes a plurality of heaters, the half-wave control unit performs the half-wave control for each of the heaters, the phase control unit performs the phase control for each of the heaters, and the determining unit further determines whether the phase control is to be performed so as to prevent the phase control from being concurrently performed for the heaters.

8. The image forming apparatus according to claim 7, further comprising an electric-value storage unit that stores electric power consumption of each of the heaters, wherein the determining unit determines, also based on magnitude of the electric power consumption of the heater, whether the phase control is to be performed for each of the heaters.

9. The image forming apparatus according to claim 8, wherein the phase control unit performs the phase control for a period of time further depending on the electric power consumption.

10. The image forming apparatus according to claim 1, wherein the measuring unit includes a timer that measures, as the heater-off period of time, duration from a point in time where the heater is switched off to a point in time where the heater is switched on.

11. The image forming apparatus according to claim 1, further comprising zero-crossing detecting circuit that detects a zero-crossing point of the alternating voltage, wherein the measuring unit counts zero-crossing points that are detected by the zero-crossing detecting circuit one by one from a point in time where the heater is switched off to a point in time where the heater is switched on to obtain a period of time depending on a counted value as the heater-off period of time.

12. The image forming apparatus according to claim 1, wherein the measuring unit measures, for the each control cycle, duration from a point in time where the heater is switched off to a point in time where the heater is switched on.

13. The image forming apparatus according to claim 1, wherein the phase control unit performs the phase control only for a period of an execution period of time calculated from the measured heater-off period of time by using a predetermined equation, the equation showing that the longer the heater-off period of time is, the longer the execution period of time becomes.

14. The image forming apparatus according to claim 1, further comprising a storage unit that stores therein the heater-off period of time associated with an execution period of time, the execution period of time being set such that the longer the heater-off period of time is, the longer the execution period of time becomes, wherein the phase control unit performs the phase control only for the execution period of time that is associated with the heater-off period of time in the storage unit.

15. A heater control method to be executed in an image forming apparatus that includes a fixing unit, a heater provided in the fixing unit, a temperature measuring unit that measures temperature of the fixing unit, an alternating-current power source that applies an alternating voltage to the heater, a storage unit, a half-wave control unit, a measuring unit, a determining unit, and a phase control unit, the heater control method comprising:

storing, in the storage unit, a plurality of patterns controlling on/off of the heater on a half-wavelength basis of a voltage cycle pertaining to the alternating-current power source;

determining, using the half-wave control unit, a pattern from the patterns stored in the storage unit based on the temperature measured by the temperature measuring unit and a target temperature of the fixing unit;

performing, using the half-wave control unit, half-wave control to control the heater according to the determined pattern;

measuring, by the measuring unit, when the heater is switched off, a heater-off period of time that elapses until the heater is next switched on;

determining, by the determining unit, based on the measured heater-off period of time, whether phase control is to be performed on the alternating voltage to control the heater, the phase control being performed by shifting phase of the alternating voltage; and performing, using the phase control unit, when it is determined that the phase control is to be performed, the phase control only for a period of time depending on the measured heater-off period of time measured at the measuring after switch-on of the heater and before execution of the half-wave control.

* * * * *